United States Patent [19]

Bierlich

[11] 4,106,237

[45] Aug. 15, 1978

[54] WINDOW ASSEMBLIES

[76] Inventor: Johannes Harald Bierlich, 15 Oresundshoj, Charlottenlund, Denmark

[21] Appl. No.: 762,292

[22] Filed: Jan. 25, 1977

[30] Foreign Application Priority Data

Feb. 2, 1976 [GB] United Kingdom ..... 4059/76

[51] Int. Cl.[2] ..... E05D 7/06

[52] U.S. Cl. ..... 49/249; 49/252; 49/253

[58] Field of Search ..... 49/248–253, 49/149, 153, 154, 398

[56] References Cited

U.S. PATENT DOCUMENTS

| | | | |
|---|---|---|---|
| 1,497,042 | 6/1924 | Taylor | 49/248 |
| 1,552,723 | 9/1925 | Mielenz | 49/248 |
| 2,419,524 | 4/1947 | Albano | 49/252 |

FOREIGN PATENT DOCUMENTS

| | | | |
|---|---|---|---|
| 2,204,828 | 2/1972 | Fed. Rep. of Germany | 49/248 |

*Primary Examiner*—Kenneth Downey
*Attorney, Agent, or Firm*—Brisebois & Kruger

[57] ABSTRACT

The invention concerns a window assembly in which the sash is mounted in the window frame for opening inwardly about hinges at the lower end of the sash and is supported in partially and fully open positions by telescopic stays extending between the top of the frame and pivots at the midpoints of the sides of the sash, the hinges being slidable in upright guides on the frame stiles so that when the stays are fully extended the sash can be tilted about the midpoint pivots with simultaneous sliding movement of the hinges up the guides to reverse the sash with the outside of the glass pane facing inwardly for easy cleaning.

6 Claims, 5 Drawing Figures

Fig.2
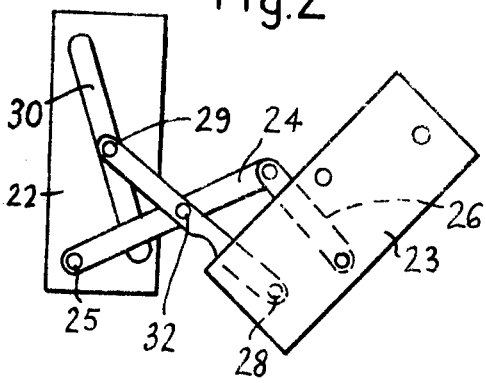
Fig.5
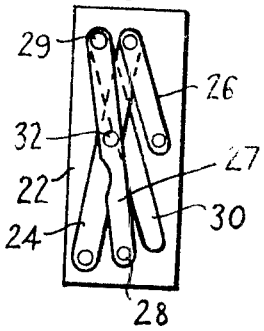
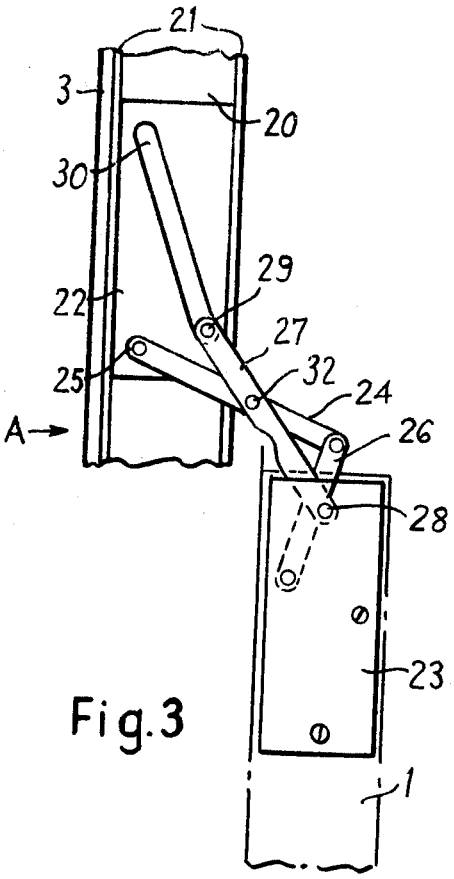
Fig.3
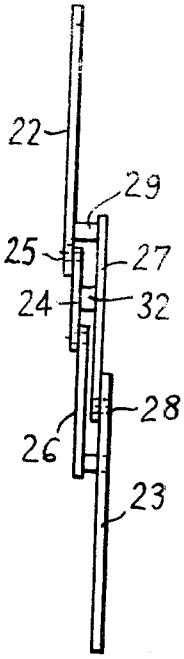
Fig.4

WINDOW ASSEMBLIES

FIELD OF THE INVENTION

The present invention concerns a window assembly comprising a substantially rectangular sash mounted in a window frame for swinging movement about hinge means, the hinge means providing a horizontal axis which is adjacent the bottom of the window sash. Normally such window assemblies will be mounted in a building wall so that the sash swings inwardly into the building and it is in this sense that the term "inwardly" will be used hereinafter.

CROSS REFERENCE TO RELATED CASE

Various constructions have been proposed for enabling the sash to be turned over so that the outside of the window glass may be easily cleaned from inside the building. One such arrangement is described in my copending application Ser. No. 703,293.

SUMMARY OF THE INVENTION

The present invention has for its object to provide an improved construction which achieves the above object in a manner which does not require any part of the sash to project outwardly of the window frame during the turn-over movement.

The present invention consists in a window assembly comprising a substantially rectangular sash mounted in a window frame for inward swinging movement about hinge means providing a horizontal axis which is adjacent the bottom of the sash, wherein said hinge means are slidable in upright guides on the stiles of the window frame, and further comprising two extensible stays each respectively connected by pivot connections to the approximate midpoint of a side of the sash and to a point adjacent the top of the corresponding stile of the frame, these stays in their fully extended positions permitting the sash to be tilted about the said midpoint pivots with simultaneous sliding movement of the hinge means up and down the respective guides.

Releasable means may be provided for limiting the extension of said stays so as to latch the sash in a partially-open or intermediate position for ventilation purposes. When the stays are fully extended, the sash hinges to an open position in which the sash can be tilted about the midpoint pivot connections to the stays with the hinge means sliding upwards in said vertical guides. Preferably the releasable means are arranged automatically to relatch when the sash has been returned to its closed or intermediate position.

Each extensible stay may comprise a pair of telescopically-interconnected arms, the lower end of the lower arm being pivotally connected to the midpoint of the vertical side of the sash associated therewith and the upper end of the upper arm being pivotally connected to the window frame stile via a link member.

The hinge means are preferably such that during pivoting movement of the sash thereabout the pivot axis provided by the hinge means moves inwardly to allow the sash to be reversed inside the frame.

Thus each hinge means may comprise first and second members, one adapted to be connected to the window frame and the other to the sash, the two members being interconnected by a "lazy-tongs" arrangement of levers which permits one member to pivot relative to the other in such a manner that the pivot axis moves inwardly. The lever arrangement may comprise first and second levers pivotally interconnected at a point intermediate their ends, said first lever having one end thereof pivotally connected to said first member and the other end thereof slidably located in a groove or slot in said second member, and said second lever having one end thereof pivotally connected to said second member and the other end thereof pivotally connected to a link member which itself is pivotally connected to said first member.

In order that the present invention may be more readily understood an embodiment thereof will now be described with reference to the accompanying drawings, in which:

BRIEF DESCRIPTION OF THE DRAWINGS

FIG. 2 is a side view of one of the lower hinges of the window of FIG. 1 showing the hinge in a partially open position of the sash, FIG. 3 is a similar view showing the hinge in the fully open position of the sash, FIG. 4 is a view in direction arrow A of FIG. 3, and FIG. 5 is a side view of the hinge, with one of the plates of the hinge removed, showing the hinge in the closed position of the sash.

DETAILED DESCRIPTION OF THE INVENTION

Figure 1:
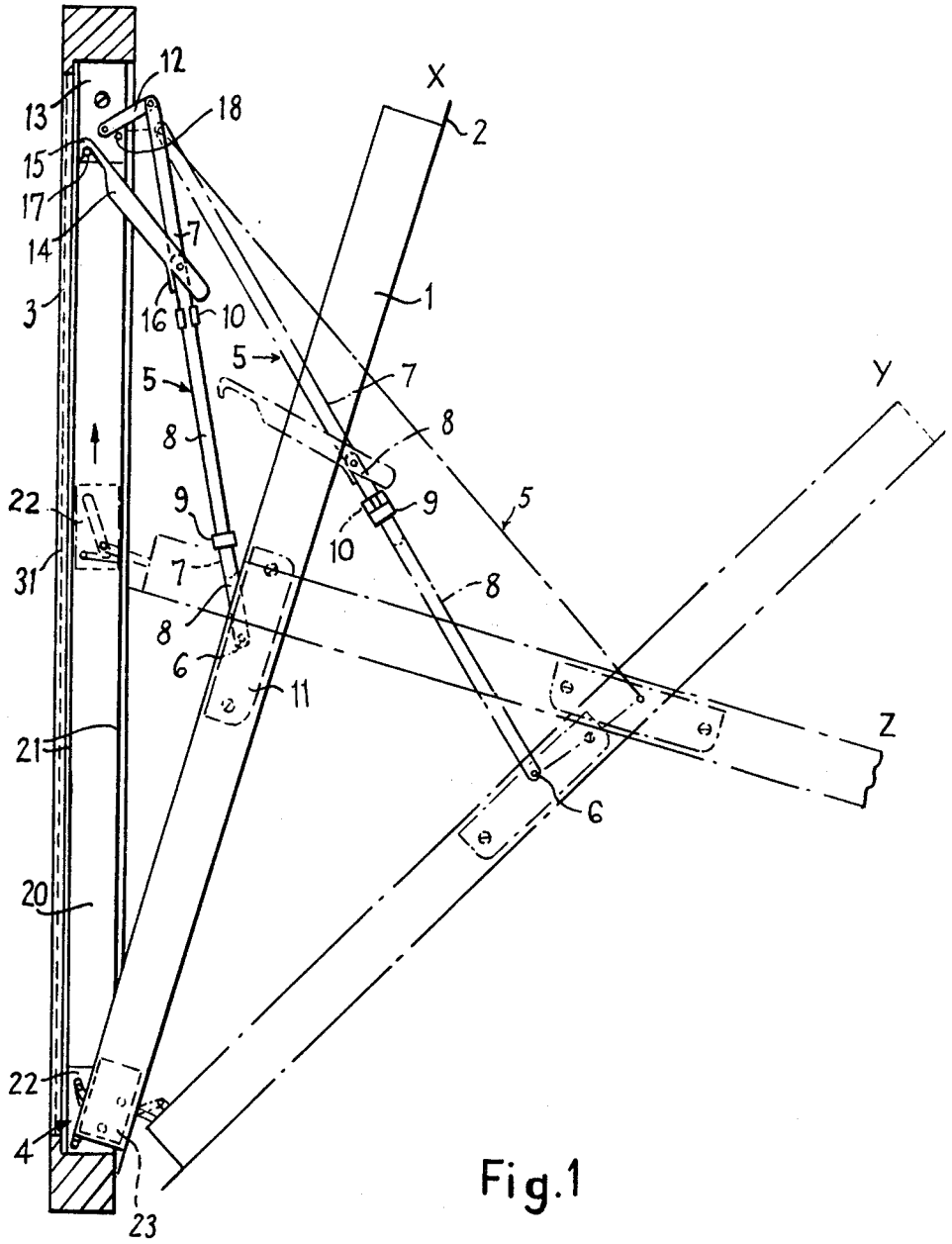
FIG. 1 is a side view of a window constructed in accordance with the present invention and showing the window sash in three different positions.

The window shown in FIG. 1 comprises a rectangular sash 1 of conventional form carrying a glass window pane. The sash 1 is provided with a flange 2 so that the window is of the type having an internal rebate.

The sash 1 is pivoted at opposite sides of its lower end to a window frame 3 by a pair of similar hinges one of which is indicated at 4. FIGS. 2 to 5 show this hinge in greater detail. The sash 1 is also fitted on both of the vertical sides thereof with a pair of extensible stays 5 each of which is pivotally connected at 6 to the midpoint of one vertical side of the sash 1, the upper end of each stay being connected to the window frame as later described. Again FIG. 1 only shows one of the stays 5. When the window is closed the sash 1 fits within the frame 3 with the flange 2 sealing the gap between the sash and window frame. Additional sealing strips may be provided to seal this gap.

The hinges 4 and stays 5 are so designed that they allow the sash 1 to swing through a number of different positions, three of which are shown at X, Y and Z in FIG. 1. Thus each stay 5 comprises upper and lower arms 7 and 8 which are telescopically interconnected so that the length of the stay is variable. The arms 7 and 8 are respectively provided with loops 9 and 10 through which the other arm slides and which limit the maximum extension of the stay. The lower end of a lower arm 8 is pivotally connected at 6 to a plate 11 fixed halfway along a vertical side of the sash 1, this midpoint connection ensuring that the sash 1 is always in a balanced condition during tilting movements about pivots 6. The upper arm 7 of the stay is connected via a pivoted link 12 to a plate 13 screwed to the side of the window frame 3. Each arm 8 has pivotally mounted thereon a latch arm 14 having a hooked portion 15 at its free end. A stop 16 on the arm 8 limits pivotal movement of the latch arm 14 relative to the arm 8. Thus, upon starting to open the sash, the stays 5 extend until the hooked-portions 15 on the arms 14 latch onto inwardly projecting pins 17 carried by each plate 13; in this position the link 12 is spaced from a stop 18, on plate 13, which limits downward movement of the link 12. Further extension of the stays 5 is thus prevented and the sash is held in an intermediate, partially-open position for ventilation purposes. This is the position X in FIG. 1. When it is desired to open the window further, the latch arms 14 can be released from the pins 17 by pressing manually on either the latch arms 14 or the stays 5 so that the hooked portions 15 slip off their respective pins 17 to allow further extension of the stays 5. When the sash is moved through position X towards a closed position the latch arms 14 will automatically relatch on the pins 17.

With the latch arms 14 released the sash 1 is free to hinge to the position Y shown in FIG. 1 in which position the link 12 rests against stop 18 and the loops 9 and 10 engage to hold the stays in their maximum extended positions. The sash 1 is in a balanced condition ready to be turned over about the midpoint pivot connections 6 so that the outside of the window faces inwards. To permit this turning, the hinges 4 are arranged to slide in vertical guides 20 defined by flanges 21 provided on the inner vertical surfaces of the stiles of the frame 3. By means of this arrangement the sash 1 can be tilted from position Y through position Z until the hinges 4 have opened into the position shown in FIG. 3 with the sash 1 hanging substantially vertically downwardly. During this pivoting movement the hinges 4 ride up the guides 20 and the stays 5, after first swinging away from frame 3, swing back towards the frame so that the sash 1 hangs downwardly with what was its lower end in a position adjacent the plates 13, the outer surface of the glass then facing inwardly at a convenient height for cleaning. The pivoted links 12 ensure that clearance is given to the hinged end of the sash as it moves towards the plates 13.

As shown in FIGS. 2 to 5 each hinge 4 comprises a pair of rectangular metal plate members 22 and 23 lying in parallel planes and pivotally interlinked by a "lazy tongs" arrangement of levers such that, during pivoting movement between the members 22, 23 in the direction to open the sash, the pivot axis moves inwardly of the plane of the frame 3 to allow the lower edge of the sash 1 to clear the frame 3. The plate 22 of each hinge 4 is mounted so that it can slide in a vertical track 20 in the window frame, whilst each plate 23 is secured by suitable screws to the sash 1. In order to facilitate the sliding movement and also to reduce wear, the plate 22 may be backed by or coated with an anti-friction bearing material. The lever arrangement includes an arm 24 pivoted at 25 to plate 22 and having its other end pivotally connected to the plate 23 via a link arm 26. The arm 24 is also pivotally interconnected at a point 32 intermediate its ends to a further arm 27; one end of this arm 27 is pivotally connected at 28 to the plate 23 and the other end of the arm 27 carries a pin 29 slidably engaged in an inclined slot 30 in the plate 22. This arrangement of pivoted and interconnected levers 24, 26 and 27 ensures that, during opening, the sash 1 is moved bodily inwardly from the frame firstly to allow its flange 2 to clear the frame (see FIG. 1) and then to allow the sash to assume its reversed position inwardly of the frame 3 (see FIG. 3).

In the embodiment shown the frame 3 is equipped with a fly screen 31 constituted by a sheet of wire or plastics mesh which may be fixed in position. Such screens are used to prevent insects from entering rooms even when the windows are open. It will be appreciated that the reversing arrangement described in which the sash 1 does not project outside the window frame is particularly advantageous when the frame is provided with a fixed fly screen.

The sash would, of course, be provided with a suitable operating handle (not shown) associated with fastening means for locking the sash in its closed position. Means may also be provided for locking the sash in its partially open position (position X) in order to prevent unauthorised or accidental opening of the sash beyond that position.

Various modifications may be made without departing from the scope of the invention. Thus the stiles and cross-members of the sash and frame may be manufactured from extruded aluminum sections, and may include thermal breaks. Further, the latching arrangement carried by each extensible stay may comprise a releasable locking mechanism acting between the two arms of the telescopic stay.

I claim:

1. A window assembly comprising a substantially rectangular sash mounted in a window frame for opening by inward swinging movement about hinge means providing a horizontal axis which is adjacent the bottom of the sash, said hinge means being slidable in upright guides on the stiles of the window frame, and two extensible stays each respectively connected by pivot connections to the approximate midpoint of a side of the sash and to a point adjacent the top of the corresponding stile of the frame, said stays in their fully extended positions permitting the sash to be tilted about the said midpoint pivots with simultaneous sliding movement of the hinge means up and down the respective guides, the said hinge means comprising two first members slidable in the upright guides on the frame stiles respectively, two second members respectively fixed to the two sides of the sash and each having pivot means on said horizontal axis, a first lever interconnecting each said pivot means with its associated first member and a lever arrangement co-acting with said first lever for displacing said pivot means and said horizontal axis inwardly of the window frame upon initial opening of the sash and in the reverse direction upon closing the sash.

2. An assembly as claimed in claim 1, and including releasable means for limiting the extension of the stays at a position less than their maximum extension and in which the sash is held in a partially open position.

3. An assembly as claimed in claim 1, wherein each extensible stay comprises a pair of telescopically interconnected arms, the lower end of the lower arm being connected to the approximate midpoint of a side of the sash and the upper end of the upper arm being pivotally connected to a stile of the window frame by means of a link member.

4. An assembly as claimed in claim 1, wherein the lever arrangement includes a second lever pivoted to the second member and having its other end pivotally connected to the second member by means of a link, and also pivotally connected at a point intermediate its ends to said first lever one end of which is pivotally connected to the second member and the other end of which is slidably engaged in a slot in the first member.

5. An assembly as claimed in claim 4, and including a fly screen secured to the window frame at a position forwardly of said upright guides.

6. For a window assembly comprising a substantially rectangular sash mounted in a window frame for opening by inward swinging movement about hinge means providing a horizontal axis which is adjacent the bottom of the sash, said hinge means being slidable in upright guides on the stiles of the window frame, and two extensible stays each respectively connected by pivot connections to the approximate midpoint of a side of the sash and to a point adjacent the top of the corresponding stile of the frame, said stays in their fully extended positions permitting the sash to be tilted about the said midpoint pivots with simultaneous sliding movement of the hinge means up and down the respective guides, hinge means comprising first and second generally rectangular plate members pivotally interlinked by a lever arrangement so that the plates lie in parallel planes, means defining a diagonal slot in said first member, said lever arrangement comprising a link member, a first lever, means pivotally connecting one end of said first lever to the first plate member at a point adjacent a corner thereof which is not aligned with said diagonal slot, means pivotally connecting said first lever at its other end to one end of said link, means pivotally connecting the other end of said link to said second plate member, a second lever, means pivotally connecting the approximate midpoint of said second lever to said first lever at a point intermediate its ends, means at one end of said second lever in sliding engagement with said slot, and means pivotally connecting the other end of said second lever to said second member.

* * * * *